US007520015B1

(12) United States Patent
Ajello

(10) Patent No.: US 7,520,015 B1
(45) Date of Patent: Apr. 21, 2009

(54) PORTABLE SUBMERSIBLE CLEANING DEVICE

(76) Inventor: Mike Ajello, 3480 W. Warner Ave., Santa Ana, CA (US) 92704

( * ) Notice: Subject to any disclaimer, the term of this patent is extended or adjusted under 35 U.S.C. 154(b) by 0 days.

(21) Appl. No.: 11/555,782

(22) Filed: Nov. 2, 2006

Related U.S. Application Data

(60) Provisional application No. 60/732,213, filed on Nov. 2, 2005.

(51) Int. Cl.
*E04H 4/16* (2006.01)

(52) U.S. Cl. ..... 15/1.7; 210/167.16

(58) Field of Classification Search ..... 15/1.7; 210/167.15, 167.16, 167.17, 167.12
See application file for complete search history.

(56) References Cited

U.S. PATENT DOCUMENTS 4,962,559 A 10/1990 Schuman
5,317,776 A 6/1994 DeMoura
D485,652 S 1/2004 Erlich
6,797,157 B2 * 9/2004 Erlich ..... 210/94
7,060,182 B2 * 6/2006 Erlich et al. ..... 210/167.16
2005/0247613 A1 * 11/2005 Bishop et al. ..... 210/169

* cited by examiner

*Primary Examiner*—Dung Van Nguyen

(57) ABSTRACT

A portable submersible cleaning device includes a housing that has axillary opposed top and bottom apertures. The housing has a frusto-conical shape, and includes a handle and an access door removably attached thereto. A cleaning head is pivotally and removably attached to a distal end of the housing, and an exterior receptacle is abutted to an outer surface thereof. A mechanism inhales a predetermined volume of debris-saturated water upwardly through the cleaning head and along a unidirectional passageway such that debris is extracted from the debris-saturated water while clean water is expelled outwardly from the housing and reintroduced into the aqueous environment. The exterior receptacle is isolated from the aqueous environment such that power is transmitted to the inhaling mechanism while the housing is submerged beneath a water line of the aqueous environment.

9 Claims, 4 Drawing Sheets

PORTABLE SUBMERSIBLE CLEANING DEVICE

CROSS REFERENCE TO RELATED APPLICATIONS

This application claims the benefit of U.S. Provisional application Ser. No. 60/732,213, filed Nov. 2, 2005.

BACKGROUND OF THE INVENTION

1. Technical Field

This invention relates to vacuum cleaning devices and, more particularly, to a portable submersible cleaning device for removing debris from aqueous environments such as pools, spas and like bodies of water.

2. Prior Art

Pool cleaners vary widely in degree of sophistication. Existing products range from simple brushes to automatic cleaners with self-propelled vacuum heads. In many designs, the pool's circulation system is used to create the vacuum at the vacuum head in addition to filtering the influent water. In others, the vacuum may be created by applying pressurized water to the device and a filter may be contained on the vacuum head.

An efficient cleaning method provided for a water powered vacuum so that dirt particles will be removed from the pool at the point where they are disturbed by the cleaning device. A water powered vacuum can be powered in either of two ways. One way is to connect the vacuum head to the pump inlet of the pool's circulation system via a suction hose. The second way is by applying a stream of pressurized water to the vacuum head through a suitable hose. With the first method, the water is filtered by the pool's circulation system. Under the second method, a filter located on the device can be used to clean the water before it is returned to the pool, or the device can place dirt particles in suspension in the pool for removal by the filter in the pool circulation system. A water powered vacuum head may be equipped with brush bristles to dislodge dirt particles, or with wheels so that the head can be rolled along the pool surfaces.

A common way to implement this latter class of device is to hinge mount the vacuum head to the end of a pole. The user can then operate and maneuver the vacuum head without getting wet. Existing devices require two connections to be made to the vacuum head, one for the pole, and the other for either the suction hose of the pressurized water hose.

These manual pool cleansers have several drawbacks when used to clean spas. The vacuum heads equipped with wheels are too cumbersome, even when flexible, to efficiently clean smaller and more contoured surfaces. When a vacuum brush head is used, the pole is connected off center of the head toward the user side of the brush. This tends to result in unbalanced brush strokes. Both the suction type and the education type cleaners are inconvenient to use when they must be removed from the pool water. These situations occur when the cleaner must be moved from the pool to a spa. In devices that use the pool circulation system, the prime of the circulation pump must be maintained; movement of the vacuum head to a spa from a pool typically is done by shutting down the pump, disconnecting the hose from the vacuum head, holding one's hand over the exposed end of the suction hose to keep the hose filled with water, and then moving over to the spa where, underwater, either the pool head is reconnected to the hose or a head sized for spas is connected to the hose, after which the pump is restarted.

When an education-type vacuum head is used, the user runs the risk of being sprayed by the discharge of the pressurized water each time the head is removed from the pool water. Obviously, this can be avoided by turning off the external water supply each time the device is removed from the pool or spa water. However, when cleaning shallow surfaces, the discharge port of an education type vacuum head may frequently be inadvertently removed from the water, thus spraying the user.

One prior art examples shows a self-contained cordless electric pool and spa vacuum cleaner which is easily maneuverable over both flat and highly controlled underwater surfaces. A pump impeller, powered by an electric motor, is used to draw water through a compact filter cartridge. The efficiency of the filter cartridge allows for the use of a small motor and small battery which, in turn, result in the small size of the vacuum cleaner. All electrical components are enclosed in a watertight chamber so as to allow the entire cleaner to be submerged under water. Such a prior art example does not employ the advantageous bifurcated chamber of the present invention.

Another prior art example shows a new and improved swimming pool vacuum apparatus that includes an extensible handle assembly which serves as a handle grasped by an operator and which supports a vacuum motor assembly. The vacuum motor assembly is used for providing vacuum power to a vacuum head assembly which contacts the bottom and the walls of a swimming pool. The vacuum head assembly is also supported by the extensible handle assembly. An electrical conductor assembly, connected between the vacuum motor assembly and a source of AC power, is used for conducting electrical power from the source of AC power to the vacuum motor assembly.

The electrical conductor assembly includes a ground fault circuit interrupter assembly for interrupting electrical power flow from the source of AC power to the vacuum motor assembly in the event of a short circuit. The extensible handle assembly may include a plurality of handle units connected together in telescopic fashion and also includes an electrically insulating hand grip member. Unfortunately, this prior art example requires the use of a power cord which can be cumbersome and limit the effective range of the device, and an AC power source must be readily available for use. In addition, this example poses a risk of electrocution of a user or other person nearby during operating conditions.

Accordingly, a need remains for a portable submersible cleaning device in order to overcome the above-noted shortcomings. The present invention satisfies such a need by providing a device that is simple and easy to use, is lightweight yet durable in design, and assists a user to remove debris from aqueous environments such as pools, spas and like bodies of water. Such a device provides pool and spa owners and repair technicians with a convenient and effective maintenance accessory that saves valuable time, precious dollars, and much needed storage space. The lack of hoses advantageously eliminates the time-consuming hassles of dragging and wrestling with the same. The present invention is inexpensive and easily transportable.

BRIEF SUMMARY OF THE INVENTION

In view of the foregoing background, it is therefore an object of the present invention to provide a device for a portable submersible cleaning device. These and other objects, features, and advantages of the invention are provided by a portable submersible cleaning device for removing debris from aqueous environments such as pools, spas and like bodies of water.

The device includes a housing that has axially opposed top and bottom apertures. Such a housing has a frusto-conical shape, and conveniently includes a handle and an access door removably attached directly thereto. A cleaning head is pivotally and removably attached to a digital end of the housing, and an exterior receptacle is directly abutted to an outer surface thereof.

The housing further includes first and second chambers in fluid communication with each other. Such a first chamber is advantageously seated below the second chamber, and is detachable from the housing. The first chamber is effectively bifurcated into threadably engaged top and bottom halves such that the first chamber is selectively removable from the housing. Such a second chamber is monolithically defined within the housing and is in direct electrical communication with the receptacle. The access door is positioned about the first chamber for advantageously allowing a user to conveniently remove the first chamber as needed.

The cleaning head includes an intake port advantageously disposed above a bottom edge of the cleaning head. A rectilinear axle penetrates through oppositely faced beveled walls of the intake port and has opposed ends removably attached to the cleaning head. Such an axle passes through the bottom end of the housing such that the cleaning head is effectively articulated along a fulcrum axis defined along the axle for advantageously allowing the cleaning head to contact uneven surfaces during operating conditions.

The device further includes a mechanism for inhaling a predetermined volume of debris-saturated water upwardly through the cleaning head and along a unidirectional passageway defined within the housing such that undesirable debris is effectively extracted from the debris-saturated water while clean water is conveniently expelled outwardly from the housing and reintroduced into the aqueous environment. The exterior receptacle is advantageously isolated from the aqueous environment such that power is transmitted to the inhaling mechanism while the housing is submerged beneath a water line of the aqueous environment.

The inhaling mechanism includes a fiber filter removably nested within the first chamber for effectively removing angularly displaced debris from the debris-saturated water. Such a fiber filter has an axial bore formed therein such that proximal and distal ends of the axial bore are advantageously disposed adjacent to proximal and distal ends of the first chamber respectively. A one-way check valve is selectively pivotal between open and closed positions such that the debris-saturated water is conveniently introduced through the distal end of the bore and effectively permitted to flow through the bore of the fiber filter. A sponge gasket is connected to the proximal end of the first chamber and is contiguously engaged directly with the proximal end of the bore such that the fluid is effectively prohibited from being laterally displaced along an outer surface of the fiber filter.

The inhaling mechanism further includes a power motor electrically coupled to a power source housed within the receptacle. Such a motor includes a driveshaft and an impeller statically mounted to a distal end of the driveshaft. Such an impeller is axially aligned directly above the proximal end of the first chamber. The motor effectively causes the driveshaft and the impeller to simultaneously rotate along a rotational path and thereby advantageously create an upward vortex along which the debris-saturated water is angularly displaced and conveniently introduced through the bore. The motor is advantageously located within the second chamber and upstream of the fiber filter. The motor further includes a plurality of slits formed within an outer wall thereof. The housing includes a plurality of slits formed therein and cooperating with the motor slits in such a manner that the clean water is continuously discharged out from the second chamber after the debris is angularly filtered in the first chamber.

The device further includes a first anchored conduit fixedly coupled directly to the top opening of the proximal end of the housing. A plurality of auxiliary shafts is removably connected to the anchored conduit, wherein one of the auxiliary shafts is provided with a plurality of tie straps for conveniently maintaining the auxiliary shafts grouped together during non-operating conditions. Such auxiliary shafts are selectively connectable along an end-to-end connection respectively for effectively assisting a user to access hard to reach target zones within the aqueous environment.

The device further includes a 12 volt portable power supply source and a transformer electrically coupled to the power source. A battery charger is electrically coupled to the transformer, and a cylindrical battery is removably positioned within the battery charger such that the battery receives a 5 volt power supply from the power source. Such a battery is advantageously housed within the receptacle during operation conditions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
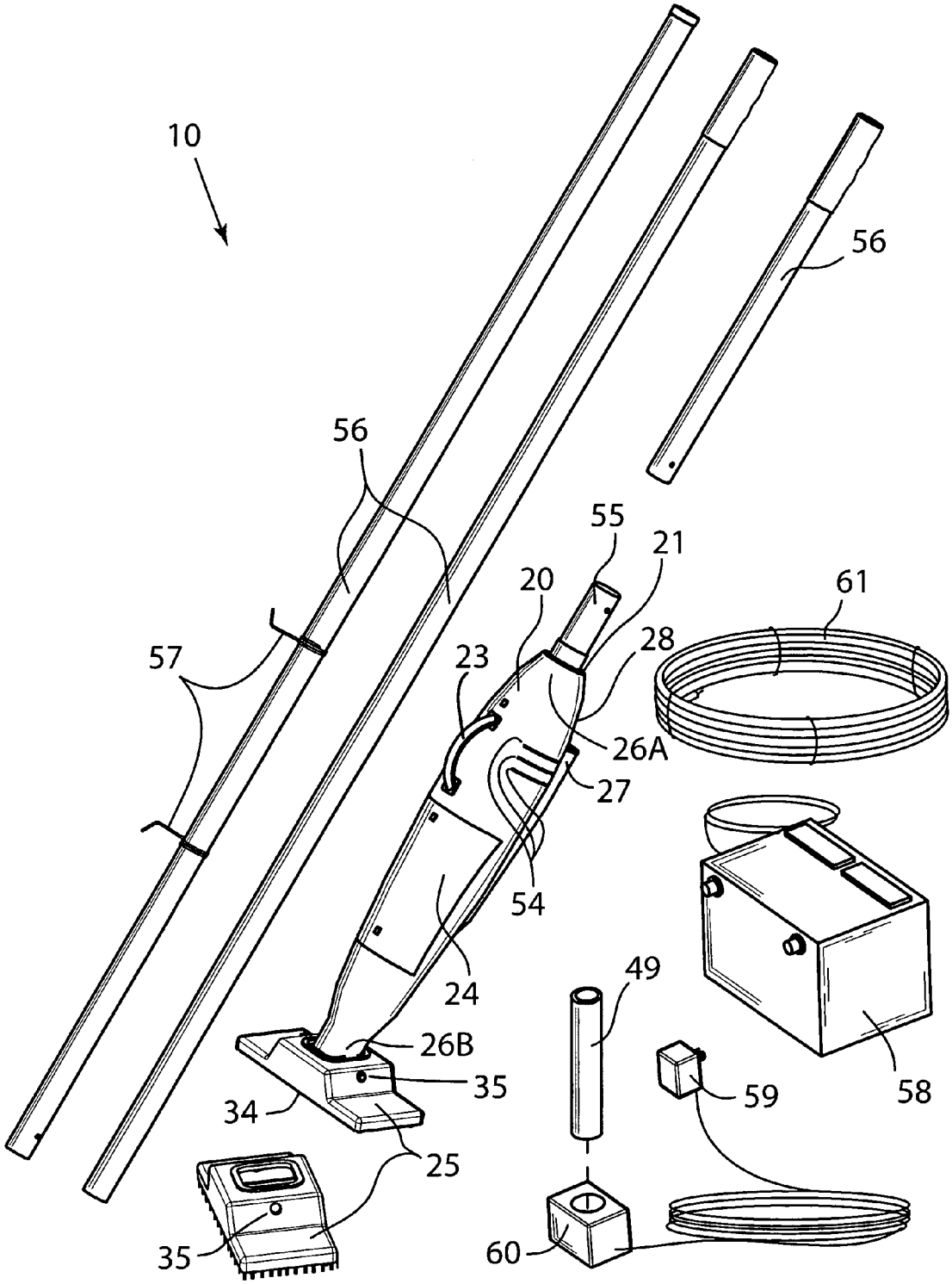
FIG. 1 is a perspective view showing a portable submersible cleaning device, in accordance with the present invention.
Figure 2:
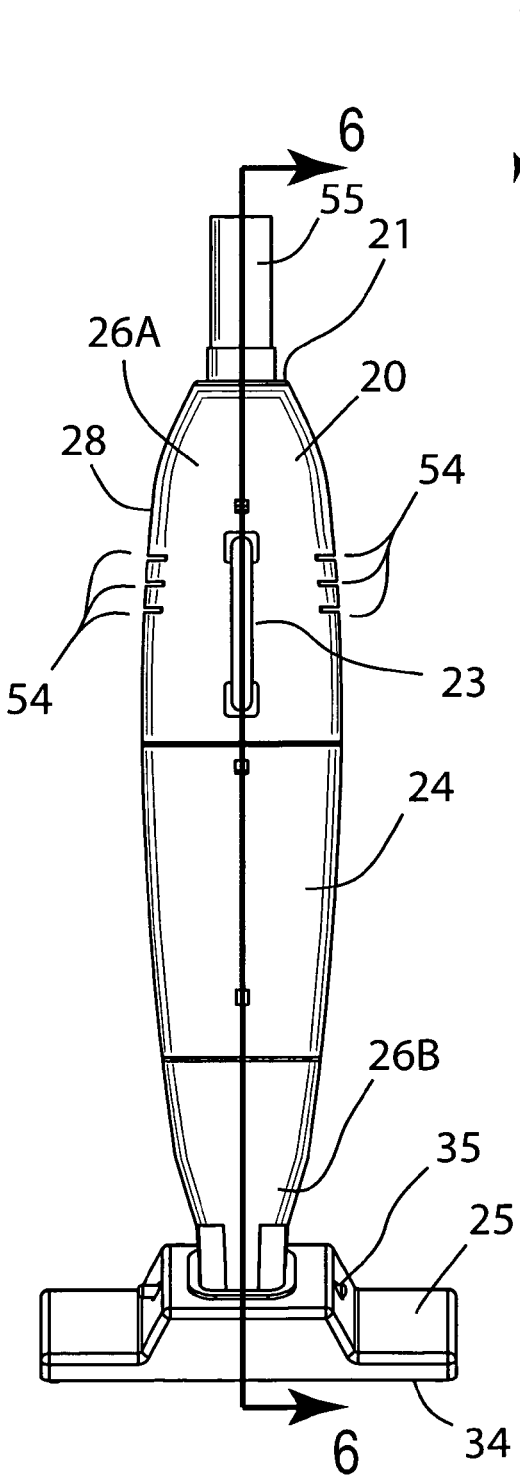
FIG. 2 is a front elevational view of the device shown in FIG. 1.
Figure 3:
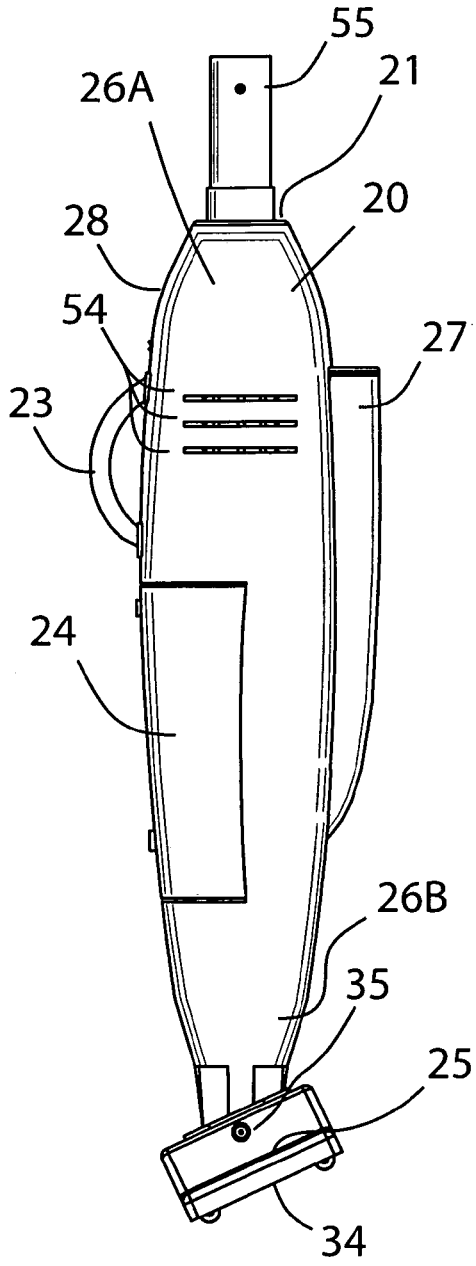
FIG. 3 is a side elevational view of the device shown in FIG. 2.
Figure 4:
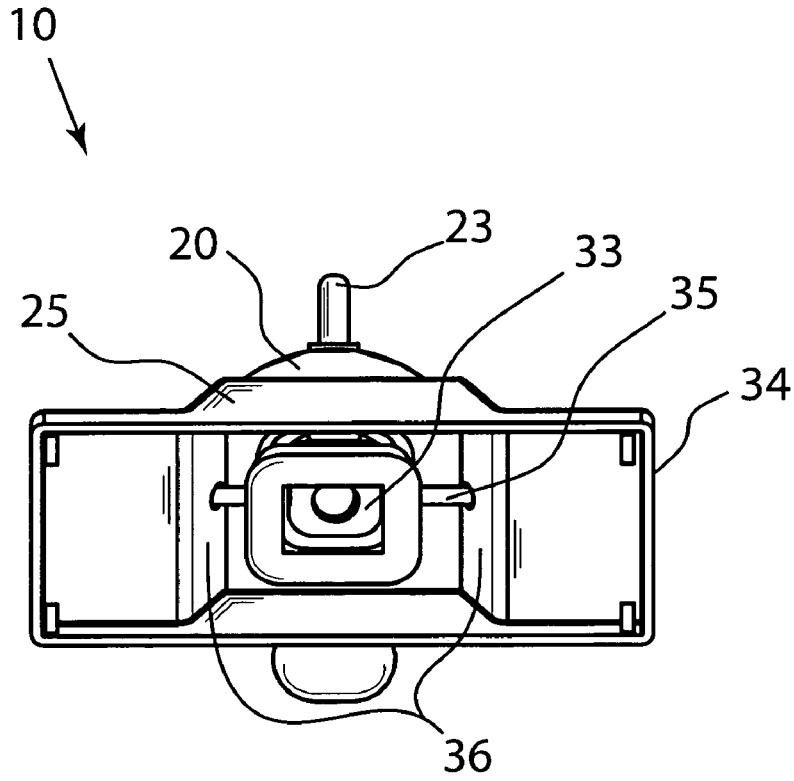
FIG. 4 is a bottom plan view of the device shown in FIG. 2.
Figure 5:
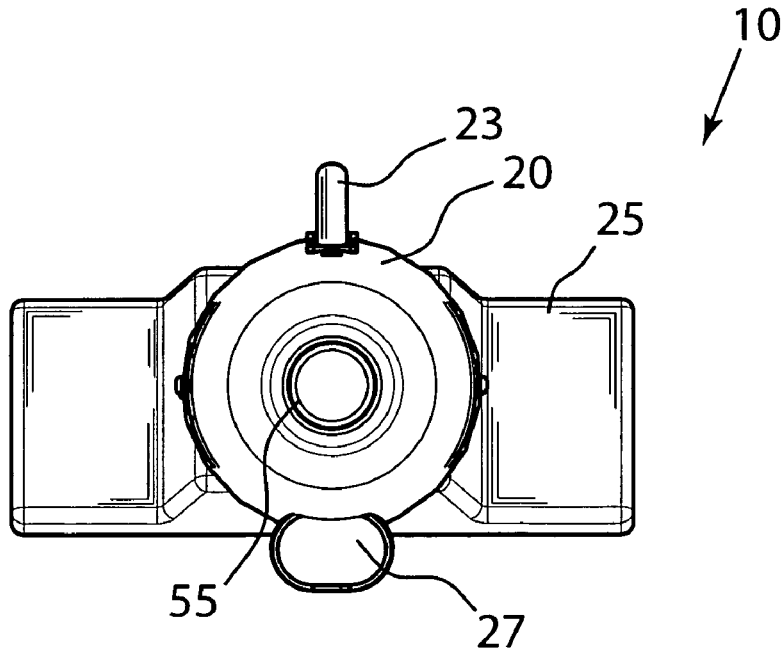
FIG. 5 is a top plan view of the device shown in FIG. 2.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-8 by the reference numeral 10 and is intended to provide a portable submersible cleaning device. It should be understood that the device 10 may be used to clean many different types of aqueous environments and should not be limited to cleaning only those aqueous environments described herein.

Referring initially to FIGS. 1, 2, 3, 4, 5 and 6, the device 10 includes a housing 20 that has axially opposed top 21 and bottom apertures. Such a housing 20 has a frusto-conical shape, and includes a handle 23 and an access door 24 removably attached directly thereto, without the use of intervening elements. A cleaning head 25 is pivotally and removably attached to a distal end 26B of the housing 20, and an exterior receptacle 27 is directly abutted to an outer surface 28 thereof, without the use of intervening elements. Of course, such apertures 21, 22 and housing 20 can be produced in a variety of shapes and sizes, as is obvious to a person of ordinary skill in the art.

Referring to FIGS. 1, 2, 3, 6, 7 and 8, the housing 20 further includes first 29 and second 30 chambers in fluid communication with each other. Such a first chamber 29 is advantageously seated below the second chamber 30, and is detachable from the housing 20. The first chamber 29 is bifurcated into threadably engaged top 31, 32 and bottom halves, which is essential such that the first chamber 29 is selectively removable from the housing 20. Such a second chamber 30 is monolithically defined within the housing 20 and is in direct electrical communication with the receptacle 27, without the use of intervening elements. The access door 24 is positioned about the first chamber 29, which is critical for advantageously allowing a user to remove the first chamber 29 as needed. Of course, such an access door 24 can be produced in a variety of shapes and sizes, as is obvious to a person of ordinary skill in the art.

Referring to FIGS. 1, 2, 3 and 4, the cleaning head 25 includes an intake port 33 advantageously disposed above a bottom edge 34 of the cleaning head 25. A rectilinear axle 35 penetrates through oppositely faced beveled walls 36 of the intake port 33 and has opposed ends removably attached to the cleaning head 25. Such an axle 35 passes through the distal end 26B of the housing 20, which is crucial such that the cleaning head 25 is articulated along a fulcrum axis defined along the axle 35 for advantageously allowing the cleaning head 25 to contact uneven surfaces during operating conditions.

Figures 6, 7, 8:
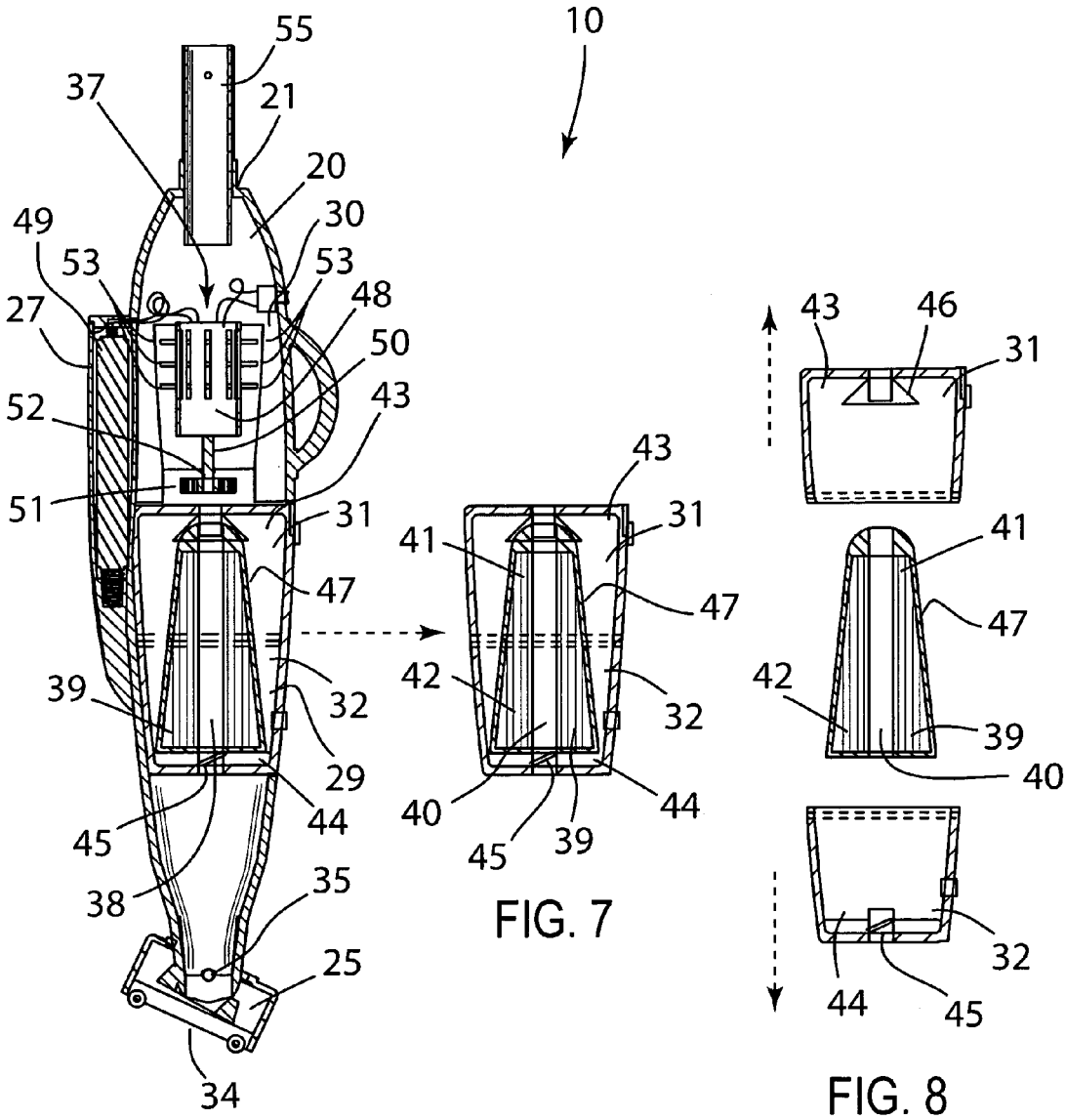
FIG. 6 is a cross sectional view of the device shown in FIG. 2, taken along line 6-6.
FIG. 7 is a cross sectional view of the first chamber and fiber filter respectively, showing the first chamber removed from the housing.
FIG. 8 is a cross sectional view of the first chamber and fiber filter respectively shown in FIG. 7, showing the top and bottom halves of the first chamber disconnected.

Referring to FIG. 6, the device 10 further includes a mechanism 37 for inhaling a predetermined volume of debris-saturated water upwardly through the cleaning head 25 and along a unidirectional passageway 38 defined within the housing 20, which is vital such that undesirable debris is extracted from the debris-saturated water while clean water is expelled outwardly from the housing 20 and reintroduced into the aqueous environment. The exterior receptacle 27 is advantageously isolated from the aqueous environment, which is important such that power is transmitted to the inhaling mechanism 37 while the housing 20 is submerged beneath a water line of the aqueous environment.

Referring to FIGS. 6, 7 and 8, the inhaling mechanism 37 includes a fiber filter 39 removably nested within the first chamber 29 for removing angularly displaced debris from the debris-saturated water. Such a fiber filter 39 has an axial bore 40 formed therein, which is essential such that proximal 41 and distal 42 ends of the bore 40 are advantageously disposed adjacent to proximal 43 and distal 44 ends of the first chamber 29 respectively. A one-way check valve 45 is selectively pivotal between open and closed positions, which is critical such that the debris-saturated water is introduced through the distal end 42 of the bore 40 and permitted to flow through the bore 40 of the fiber filter 39. A sponge gasket 46 is connected to the proximal end 43 of the first chamber 29 and is contiguously engaged directly with the proximal end 41 of the bore 40, without the use of intervening elements, which is critical such that the water is prohibited from being laterally displaced along an outer surface 47 of the fiber filter 39.

Referring to FIGS. 1, 2, 3 and 6, the inhaling mechanism 37 further includes a power motor 48 electrically coupled to a cylindrical battery 49 (herein described below) housed within the exterior receptacle 27. Such a motor 48 includes a driveshaft 50 and an impeller 51 statically mounted to a distal end 52 of the driveshaft 50. Such an impeller 51 is axially aligned directly above the proximal end 43 of the first chamber 29, without the use of intervening elements. The motor 48 causes the driveshaft 50 and the impeller 51 to simultaneously rotate along a rotational path and thereby advantageously create an upward vortex along which the debris-saturated water is angularly displaced and introduced through the bore 40. The motor 48 is advantageously located within the second chamber 30 and upstream of the fiber filter 39. The motor 48 further includes a plurality of slits 53 formed within an outer wall thereof. The housing 20 includes a plurality of slits 54 formed therein and cooperating with the motor slits 53, which is crucial such that the clean water is continuously discharged out from the second chamber 30 after the debris is angularly filtered in the first chamber 29.

Again referring to FIGS. 1, 2, 3 and 6, the device 10 further includes a first anchored conduit 55 fixedly coupled directly to the top aperture 21 of the proximal end 26A of the housing 20, without the use of intervening elements. A plurality of auxiliary shafts 56 is removably connected to the anchored conduit 55, wherein one of the auxiliary shafts 56 is provided with a plurality of the straps 57 for maintaining the auxiliary shafts 56 grouped together during non-operating conditions. Of course, such tie straps 57 can be formed from a variety of suitable materials, as is obvious to a person of ordinary skill in the art. Such auxiliary shafts 56 are selectively connectable along an end-to-end connection respectively for assisting a user to access hard to reach target zones within the aqueous environment.

Referring to FIG. 1, the device 10 further includes a 12 volt portable power supply source 58, a transformer 59 electrically coupled to the power source, and a power extension cord 61. A battery charger 60 is electrically coupled to the transformer 59, and a cylindrical battery 49 is removably positioned within the battery charger 60, which is vital such that the cylindrical battery 49 receives a 5 volt power supply from the power source 58. Such a cylindrical battery 49 is advantageously housed within the exterior receptacle 27 during operating conditions.

The present invention overcomes prior art shortcomings by employing a removable second chamber that is bifurcated in combination with the ability to effectively filter the debris from the debris-saturated water during extend uses and therefore provides the unexpected benefit of efficiently filtering the aqueous body of water.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may includes variations in size, materials, shape, form, function and manner of operation. The assembly and use of the present invention are deemed readily apparent and obvious to one skilled in the art.

What is claimed as new and what is desired to secure by Letters Patent of the United States is:

1. A portable submersible cleaning device for removing debris from aqueous environments such as pools, spas and like bodies of water, said submersible cleaning device comprising:

a housing having axially opposed top and bottom apertures;

a cleaning head pivotally and removably attached to a distal end of said housing;

an exterior receptacle directly abutted to an outer surface of said housing; and means for inhaling a predetermined volume of debris-saturated water upwardly through said cleaning head and along a unidirectional passageway defined within said housing such that undesirable debris is extracted from said debris-saturated water while clean water is expelled outwardly from said housing and reintroduced into said aqueous environment;

wherein said receptacle is isolated from said aqueous environment such that power is transmitted to said inhaling means while said housing is submerged beneath a water line of said aqueous environment;

wherein said housing comprises: first and second chambers in fluid communication with each other, said first chamber being seated below said second chamber, said first chamber being detachable from said housing, said first chamber being bifurcated into threadably engaged top and bottom halves such that said first chamber is selectively removable from said housing, said second chamber being monolithically defined within said housing and in direct electrical communication with said receptacle, an access door being positioned about said first chamber for allowing a user to remove said first chamber as needed;

wherein said inhaling means comprises:

a fiber filter removably nested within said first chamber for removing angularly displaced debris from said debris-saturated water, said fiber filter having an axial bore formed therein wherein proximal and distal ends of said axial bore are disposed adjacent to proximal and distal ends of said first chamber respectively;

a one-way check valve selectively pivotal between open and closed positions such that the debris-saturated water is introduced through said distal end of said bore and permitted to flow through said bore of said fiber filter;

a sponge gasket connected to said proximal end of said first chamber and contiguously engaged directly with said proximal end of said bore such that the fluid is prohibited from being laterally displaced along an outer surface of said fiber filter; and a power motor electrically coupled to a power source housed within said receptacle, said motor including a driveshaft and an impeller statically mounted to a distal end of said driveshaft, said impeller being axially aligned directly above said proximal end of said first chamber, said motor causing said driveshaft and said impeller to simultaneously rotate along a rotational path and thereby creating an upward vortex along which the debris-saturated water is angularly displaced and introduced through said bore, said motor being located within said second chamber and upstream of said fiber filter;

wherein said motor is provided with a plurality of slits formed within an outer wall thereof, said housing including a plurality of slits formed therein and cooperating with said motor slits in such a manner that the clean water is continuously discharged out from said second chamber after the debris is angularly filtered in said first chamber.

2. The submersible cleaning device of claim 1, wherein said cleaning head comprises:

an intake port disposed above a bottom edge of said cleaning head; and a rectilinear axle penetrating through oppositely faced beveled walls of said intake port and having opposed ends removably attached to said cleaning head, said axle passing through said bottom end of said housing such that said cleaning head is articulated along a fulcrum axis defined along said axle for allowing said cleaning head to contact uneven surfaces during operating conditions.

3. The submersible cleaning device of claim 1, further comprising:

a first anchored conduit fixedly coupled directly to said top opening of said proximal end of said housing;

a plurality of auxiliary shafts removably connected to said anchored conduit, wherein one of said auxiliary shafts is provided with a plurality of tie straps for maintaining said auxiliary shafts grouped together during non-operating conditions, said auxiliary shafts being selectively connectable along an end-to-end connection respectively for assisting a user to access hard to reach target zones within the aqueous environment;

a 12 volt portable power supply source;

a transformer electrically coupled to said power source;

a power extension cord;

a battery charger electrically coupled to said transformer; and a cylindrical battery removably positioned within said battery charger such that said battery receives a 5 volt power supply from said power source, said battery being housed within said receptacle during operating conditions.

4. A portable submersible cleaning device for removing debris from aqueous environments such as pools, spas and like bodies of water, said submersible cleaning device comprising:

a housing having axially opposed top and bottom apertures, said housing including a handle and an access door removably attached directly thereto;

a cleaning head pivotally and removably attached to a digital end of said housing;

an exterior receptacle directly abutted to an outer surface of said housing; and means for inhaling a predetermined volume of debris-saturated water upwardly through said cleaning head and along a unidirectional passageway defined within said housing such that undesirable debris is extracted from said debris-saturated water while clean water is expelled outwardly from said housing and reintroduced into said aqueous environment;

wherein said receptacle is isolated from said aqueous environment such that power is transmitted to said inhaling means while said housing is submerged beneath a water line of said aqueous environment;

wherein said housing comprises: first and second chambers in fluid communication with each other, said first chamber being seated below said second chamber, said first chamber being detachable from said housing, said first chamber being bifurcated with threadably engaged top and bottom halves such that said first chamber is selectively removable from said housing, said second chamber being monolithically defined within said housing and in direct electrical communication with said receptacle, said access door being positioned about said first chamber for allowing a user to remove said first chamber as needed;

wherein said inhaling means comprises:

a fiber filter removably nested within said first chamber for removing angularly displaced debris from said debris-saturated water, said fiber filter having an axial bore formed therein wherein proximal and distal ends of said axial bore are disposed adjacent to proximal and distal ends of said first chamber respectively;

a one-way check valve selectively pivotal between open and closed positions such that the debris-saturated water is introduced through said distal end of said bore and permitted to flow through said bore of said fiber filter;

a sponge gasket connected to said proximal end of said first chamber and contiguously engaged directly with said proximal end of said bore such that the fluid is prohibited from being laterally displaced along an outer surface of said fiber filter; and a power motor electrically coupled to a power source housed within said receptacle, said motor including a driveshaft and an impeller statically mounted to a distal end of said driveshaft, said impeller being axially aligned directly above said proximal end of said first chamber, said motor causing said driveshaft and said impeller to simultaneously rotate along a rotational path and thereby creating an upward vortex along which the debris-saturated water is angularly displaced and introduced through said bore, said motor being located within said second chamber and upstream of said fiber filter;

wherein said motor is provided with a plurality of slits formed within an outer wall thereof, said housing including a plurality of slits formed therein and cooperating with said motor slits in such a manner that the clean water is continuously discharged out from said second chamber after the debris is angularly filtered in said first chamber.

5. The submersible cleaning device of claim 4, wherein said cleaning head comprises:

an intake port disposed above a bottom edge of said cleaning head; and a rectilinear axial penetrating through oppositely faced beveled walls of said intake port and having opposed ends removably attached to said cleaning head, said axle passing through said bottom end of said housing such that said cleaning head is articulated along a fulcrum axis defined along said axle for allowing said cleaning head to contact uneven surfaces during operating conditions.

6. The submersible cleansing device of claim 4, further comprising:

a first anchored conduit fixedly coupled directly to said top opening of said proximal end of said housing;

a plurality of auxiliary shafts removably connected to said anchored conduit, wherein one of said auxiliary shafts is provided with a plurality of tie straps for maintaining said auxiliary shafts grouped together during non-operating conditions, said auxiliary shafts being selectively connectable along an end-to-end connection respectively for assisting a user to access hard to reach target zones within the aqueous environment;

a 12 volt portable power supply source;

a transformer electrically coupled to said power source;

a power extension cord;

a battery charger electrically coupled to said transformer; and a cylindrical battery removably positioned within said battery charger such that said battery receives a 5 volt power supply from said power source, said battery being housed within said receptacle during operating conditions.

7. A portable submersible cleaning device for removing debris from aqueous environments such as pools, spas and like bodies of water, said submersible cleaning device comprising:

a housing having axially opposed top and bottom apertures, said housing having a frusto-conical shape, said housing including a handle and an access door removably attached directly thereto;

a cleaning head pivotally and removably attached to a distal end of said housing;

an exterior receptacle directly abutted to an outer surface of said housing; and means for inhaling a predetermined volume of debris-saturated water upwardly through said cleaning head and along a unidirectional passageway defined within said housing such that undesirable debris is extracted from said debris-saturated water while clean water is expelled outwardly from said housing and reintroduced into said aqueous environment;

wherein said receptacle is isolated from said aqueous environment such that power is transmitted to said inhaling means while said housing is submerged beneath a water line of said aqueous environment;

wherein said housing comprises: first and second chambers in fluid communication with each other, said first chamber being seated below said second chamber, said first chamber being detachable from said housing, said first chamber being bifurcated into threadably engaged to and bottom halves such that said first chamber is selectively removable from said housing, said second chamber being monolithically defined within said housing and in direct electrical communication with said receptacle, said access door being positioned about said first chamber for allowing a user to remove said first chamber as needed;

wherein said inhaling means comprises:

a fiber filter removably nested within said first chamber for removing angularly displaced debris from said debris-saturated water, said fiber filter having an axial bore formed therein wherein proximal and distal ends of said axial bore are disposed adjacent to proximal and distal ends of said first chamber respectively;

a one-way check valve selectively pivotal between open and closed positions such that he debris-saturated water is introduced through said distal end of said bore and permitted to flow through said bore of said fiber filter;

a sponge gasket connected to said proximal end of said first chamber and contiguously engaged directly with said proximal end of said bore such that the fluid is prohibited from being laterally displaced along an outer surface of said fiber filter; and a power motor electrically coupled to a power source housed within said receptacle, said motor including a driveshaft and an impeller statically mounted to a digital end of said driveshaft, said impeller being axially aligned directly above said proximal end of said first chamber, said motor causing said driveshaft and said impeller to simultaneously rotate along a rotational path and thereby creating an upward vortex along which the debris-saturated water is angularly displaced and introduced through said bore, said motor being located within said second chamber and upstream of said fiber filter;

wherein said motor is provided with a plurality of slits formed within an outer wall thereof, said housing including a plurality of slits formed therein and cooperating with said motor slits in such a manner that the clean water is continuously discharged out from said second chamber after the debris is angularly filtered in said first chamber.

8. The submersible cleaning device of claim 7, wherein said cleaning head comprises:

an intake port disposed above a bottom edge of said cleaning head; and a rectilinear axle penetrating through oppositely faced beveled walls of said intake port and having opposed ends removably attached to said cleaning head, said axle passing through said bottom end of said housing such that said cleaning head is articulated along a fulcrum axis defined along said axle for allowing said cleaning head to contact uneven surfaces during operating conditions.

9. The submersible cleaning device of claim 7, further comprising:

a first anchored conduit fixedly coupled directly to said top opening of said proximal end of said housing;

a plurality of auxiliary shafts removably connected to said anchored conduit, wherein one of said auxiliary shafts is provided with a plurality of tie straps for maintaining said auxiliary shafts grouped together during non-operating conditions, said auxiliary shafts being selectively connectable along an end-to-end connection respectively for assisting a user to access hard to reach target zones within the aqueous environment;

a 12 volt portable power supply source;

a transformer electrically coupled to said power source;

a power extension cord;

a battery charger electrically coupled to said transformer; and a cylindrically battery removably positioned within said battery charger such that said battery receives a 5 volt power supply from said power source, said battery being housed within said receptacle during operating conditions.

* * * * *